US006880478B2

(12) United States Patent
Schmitz, Sr. et al.

(10) Patent No.: US 6,880,478 B2
(45) Date of Patent: Apr. 19, 2005

(54) TWO DEGREE OF FREEDOM RUDDER/ STABILIZER FOR WATERBORNE VESSELS

(75) Inventors: Steven J. Schmitz, Sr., Sunnyvale, CA (US); Terrence W. Schmidt, Santa Clara, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/622,235

(22) Filed: Jul. 18, 2003

(65) Prior Publication Data

US 2005/0011427 A1 Jan. 20, 2005

(51) Int. Cl.[7] ..... B63H 25/06
(52) U.S. Cl. ..... 114/162; 114/163
(58) Field of Search ..... 114/162, 163, 114/164, 165, 168, 23, 61.1, 61.12, 61.13, 122, 126, 144 C

(56) References Cited

U.S. PATENT DOCUMENTS

| | | | | | |
|---|---|---|---|---|---|
| 3,511,204 | A | * | 5/1970 | Tattersall | 114/163 |
| 3,515,089 | A | * | 6/1970 | Taggart | 114/162 |
| 3,548,776 | A | * | 12/1970 | Ford et al. | 114/163 |
| 3,842,777 | A | * | 10/1974 | Larsh | 114/126 |
| 3,983,831 | A | * | 10/1976 | Knoos et al. | 114/144 C |
| 4,444,143 | A | * | 4/1984 | Tattersall et al. | 114/163 |
| 4,552,083 | A | * | 11/1985 | Schmidt | 114/61.13 |
| 5,301,624 | A | * | 4/1994 | Hall et al. | 114/61.12 |
| 5,488,919 | A | * | 2/1996 | Ferreiro et al. | 114/122 |
| 5,511,504 | A | * | 4/1996 | Martin | 114/61.12 |
| 6,098,561 | A | * | 8/2000 | Forthmann | 114/144 C |
| 6,213,042 | B1 | * | 4/2001 | Delfosse | 114/61.1 |

* cited by examiner

*Primary Examiner*—Lars A. Olson
(74) *Attorney, Agent, or Firm*—Simpson & Simpson, PLLC

(57) ABSTRACT

A method and apparatus for steering a vessel comprising a member rotatable around a first and a second axis.

44 Claims, 11 Drawing Sheets

TWO DEGREE OF FREEDOM RUDDER/ STABILIZER FOR WATERBORNE VESSELS

FIELD OF THE INVENTION

This invention relates to the control of waterborne vessels. More specifically it relates to a method and apparatus for coupled maneuvering and ride control of waterborne vessels. Even more specifically, the present invention relates to a two degree of freedom rudder/stabilizer for waterborne vessels.

BACKGROUND OF THE INVENTION

Waterborne vessels are typically maneuvered using a conventional rudder located at or near the stern of the ship. A conventional rudder is a substantially planar member that is rotated around an axis perpendicular, or nearly perpendicular, to the surface of the water. Ride quality, namely minimization of undesirable vessel pitch and roll, is provided by having one or more of the following: a small waterplane area ship, control surfaces such as canards, stabilizers, and/or foils, an automatic control system, and other active devices. Canards 2 and stabilizers 4 (shown in FIG. 1) are substantially planar members rotated about an axis parallel, or nearly parallel, to the surface of the water. Canards are typically located forward of the center of gravity of the vessel. Stabilizers are typically located aft of the center of gravity, while foils are located forward or aft of the center of gravity. Water flowing over a control surface creates a lift force normal to the direction of flow and a drag force parallel to the direction of flow acting at the center of pressure. The magnitude of the lift and drag force is proportional to the size of the control surface and the inflow velocity over the surface. When a control surface is rotated about its axis, the magnitude and direction of this hydrodynamic force changes. In the case of a rudder, this hydrodynamic force applied at the stern of the ship creates a turning moment around the center of mass, turning the vessel in the direction of the moment. In the case of canards, stabilizers, or foils, this hydrodynamic force acting on any or all the control surfaces creates a pitching and/or rolling moment around the center of mass, rotating the vessel in the direction of the moment.

Waterborne vessels that require good ride quality and high maneuverability, at all speeds, will most likely have a small waterplane, incorporate canards, stabilizers, and/or foils for ride control, and rudder(s) for maneuvering. However, incorporating all these control surfaces on a ship can have an adverse affect on the top speed due to the drag associated with each control surface.

Maneuvering: When a ship is executing a turn, a centrifugal force is generated, which acts horizontally through the center of gravity. The magnitude of the centrifugal force is proportional to the weight of the vessel, the square of the vessel velocity and the radius of turn. This centrifugal force is balanced by a horizontal water pressure acting on the underwater portion of the ship, as illustrated in FIG. 2. This heeling moment, which increases with the square of the forward speed of the vessel, tends to roll the vessel in a direction opposite to the direction of a steady turn. The ship will heel until the moment of the ship's weight and buoyancy, the righting moment, equals that of the centrifugal force and the water pressure. The righting moment is generated by the shifting of the center of buoyancy of the vessel opposite the direction of the turn, as shown in FIG. 2. Ships with large waterplane areas resist this heeling moment better than ships with small waterplane areas, reducing the angle of inclination or roll angle. However, ride quality is compromised. Small waterplane area vessels will have superior ride quality compared to large waterplane area ships but tend to experience greater roll angles during a turn because of their reduced waterplane area. Although, conventional rudders, and some canards and stabilizers, known in the art, will provide a moment that resists the heeling moment, they typically do not provide the required hydrodynamic force sufficient to prevent the ship from rolling out of the turn. If the rudder is large enough, or separated sufficiently far from the ship's center of gravity a moment sufficient to counter the heeling moment can result in a level turn or roll into the turn. Unfortunately, neither of these choices is desirable due to the excessive drag or possible extensive draft from the large rudder.

Ride quality: When a ship experiences waves in a seaway, hydrodynamic forces, caused by surface effects and pressure distributions along the hull, cause undesirable pitching and rolling moments on the ship. Small waterplane area ships are more resilient to these undesirable motions than large waterplane area ships; however they still experience some level of roll and pitch motions. A motion control system utilizing canards, stabilizers, and/or foils are often incorporated in a ship design to prevent these unwanted motions. Clearly, the size of the control surfaces and the separation distance from the center of gravity have an impact on the ability to resist these motions.

Having separate control surfaces for ride control, such as canards and stabilizers, and rudders for turning can affect the vessel top speed and limit the choices to the operator. It has been a long felt desire by naval architects and marine engineers to design a ship with superior ride quality and high maneuverability, while hot compromising the vessel top speed. These conflicting requirements continually pose a challenge to the designers.

Clearly, then, there is a long felt need for a control surface or combination of control surfaces that enable a vessel to be steered along a desired heading, while also minimizing rolling and pitching moments. Further, there is a long felt need for a vessel able to execute a turn at any desired speed with the vessel rolling into the turn. Finally, there is a need to implement the above capabilities without imposing excessive drag on the vessel.

SUMMARY OF THE INVENTION

The present invention broadly comprises a method and apparatus for steering and controlling a vessel on a fixed heading or on a changing heading, such as when in a turn. The apparatus comprises a member having a control surface. The member is rotatable around a first and a second axis.

A general object of the present invention is to provide a control surface that minimizes rolling and pitching moments.

These and other objects, features and advantages of the present invention will become readily apparent to those having ordinary skill in the art upon a reading of the following detailed description of the invention in view of the drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE PREFERRED EMBODIMENT

It should be appreciated that, in the detailed description of the invention that follows, like reference numbers on different drawing views are intended to identify identical structural elements of the invention in the respective views. This invention is applicable to all multihull vessels that utilize control surfaces for maneuvering and ride control such as rudders, canards, stabilizers, and foils. This invention is in no way restricted to installation of such a system on the underwater hulls only but can also be applied to underwater crossfoils or appendages protruding from the primary underwater hull(s).

This invention relates to a 2 degree of freedom rudder/stabilizer capable of satisfying the control effectiveness of two separate control surfaces, namely a rudder used for turning and a stabilizer, canard, or foil used for ride control. This invention, which utilizes a substantially planar surface, incorporates 2 axes of rotation into a single system. This 2 degree of freedom rudder/stabilizer has the ability to be deflected about an axis, $X_1$, parallel to the ship's hull, and also about a second axis, $X_2$, perpendicular to $X_1$ and perpendicular to the water surface when $X_2$ is not rotated (see FIG. 4). Rotating the rudder/stabilizer about $X_1$, through an angle $\tau$ (see FIG. 3), also rotates axis $X_2$ so that it is no longer perpendicular to the water surface. When this rudder/stabilizer is rotated about axis $X_1$ and $X_2$ a tremendous advantage over a conventional rudder can be realized both at high speeds and low speeds, during straight ahead travel or during a turn.

Figure 1:
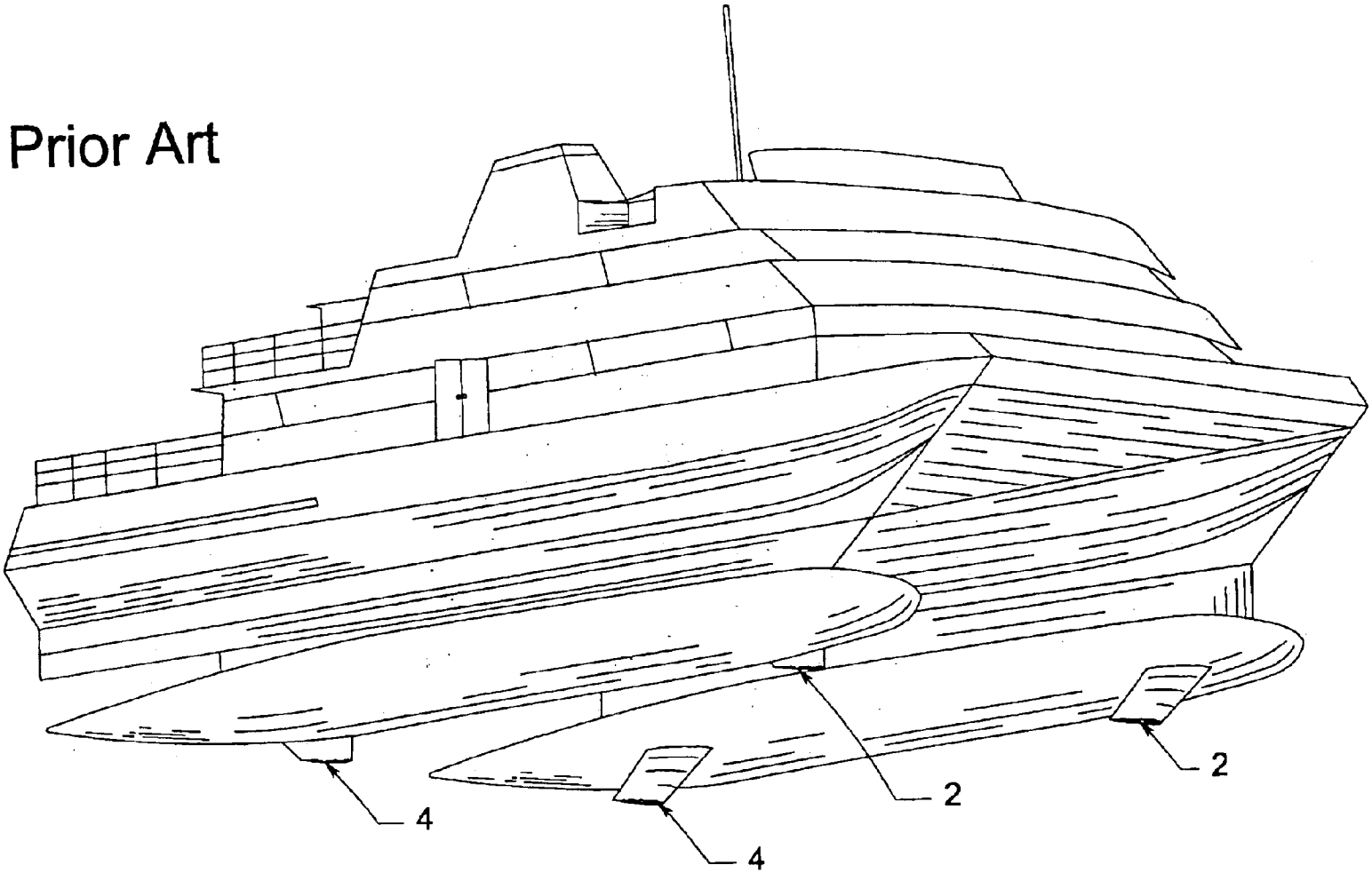
Prior Art Fig. 1
FIG. 1 is a perspective view of a vessel with conventional canards and stabilizers.
Figure 2:
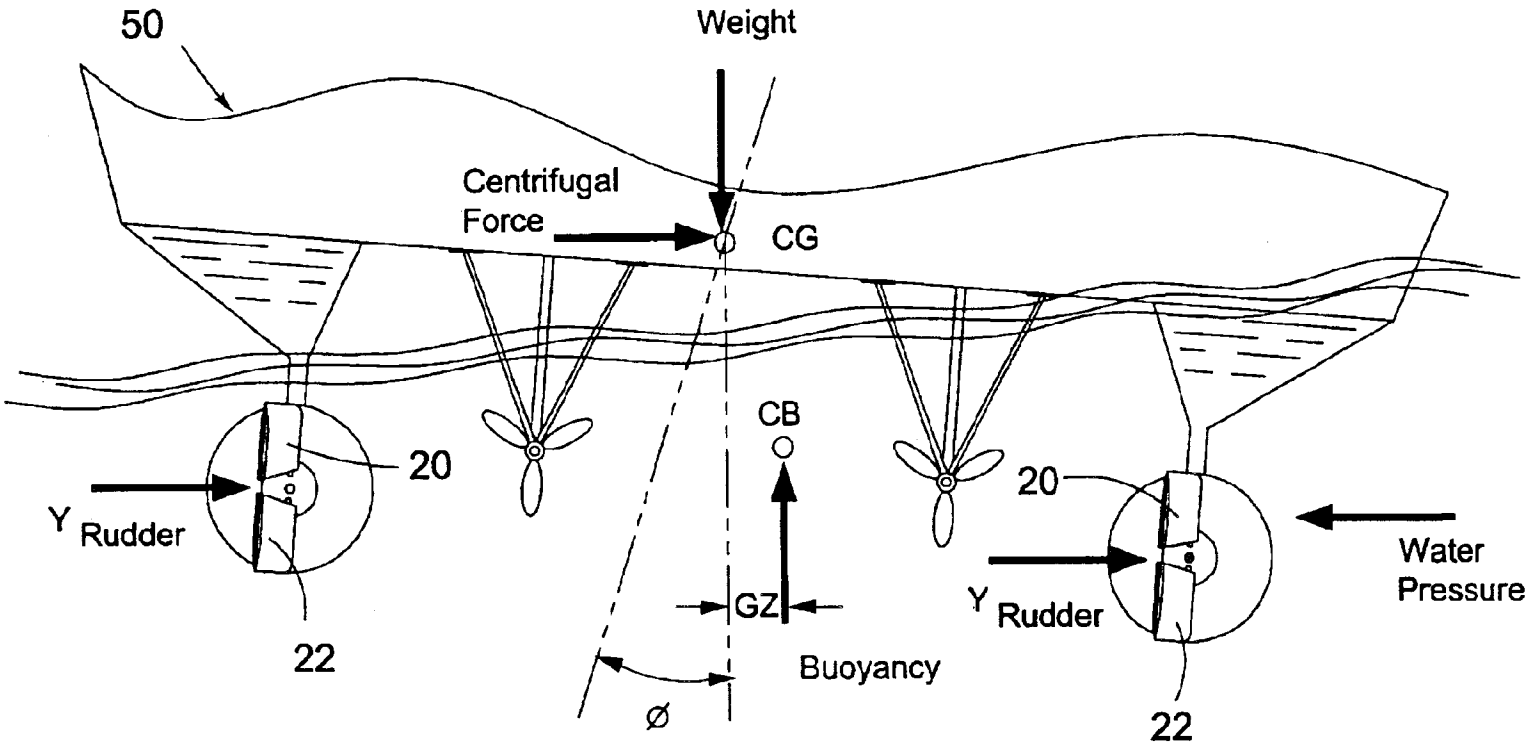
Prior Art Fig. 2
FIG. 2 is a rear view of a conventional vessel, showing the roll angle created by the heeling moment due to a turn.

As described earlier, FIG. 2 shows the forces on a ship with a conventional rudder. A centrifugal force exerted on a steady turning ship induces a roll moment opposite to the direction of turn. This centrifugal force is quite large during high speed turns and thus the roll angle is quite large, and at low speeds when the centrifugal force is low the roll angle is generally quite small. This rolling moment caused by the centrifugal force and the distance between the center of gravity and the point of lateral resistance, called the heeling moment, is equal to:

$$HM = \frac{WV^2 a\cos\phi}{gR}$$

where HM is the heeling moment, W is the weight of water displaced by the ship (displacement), V is the linear velocity of the ship in the turn, a is the vertical distance between the center of gravity of the ship (CG on FIG. 2) and the center of lateral resistance (Water Pressure on FIG. 2) with the ship upright (typically half draft), $\phi$ is the roll angle, g is the acceleration due to gravity, and R is the radius of the turn. The heeling moment, which increases with: the square of the forward speed of the vessel, must be reacted by an equal and opposing moment, the righting moment. The righting moment is generated by the shifting of the center of buoyancy of the vessel opposite the direction of the turn, as shown in FIG. 2, and a smaller restoring moment due to the rudder.

Figure 3:
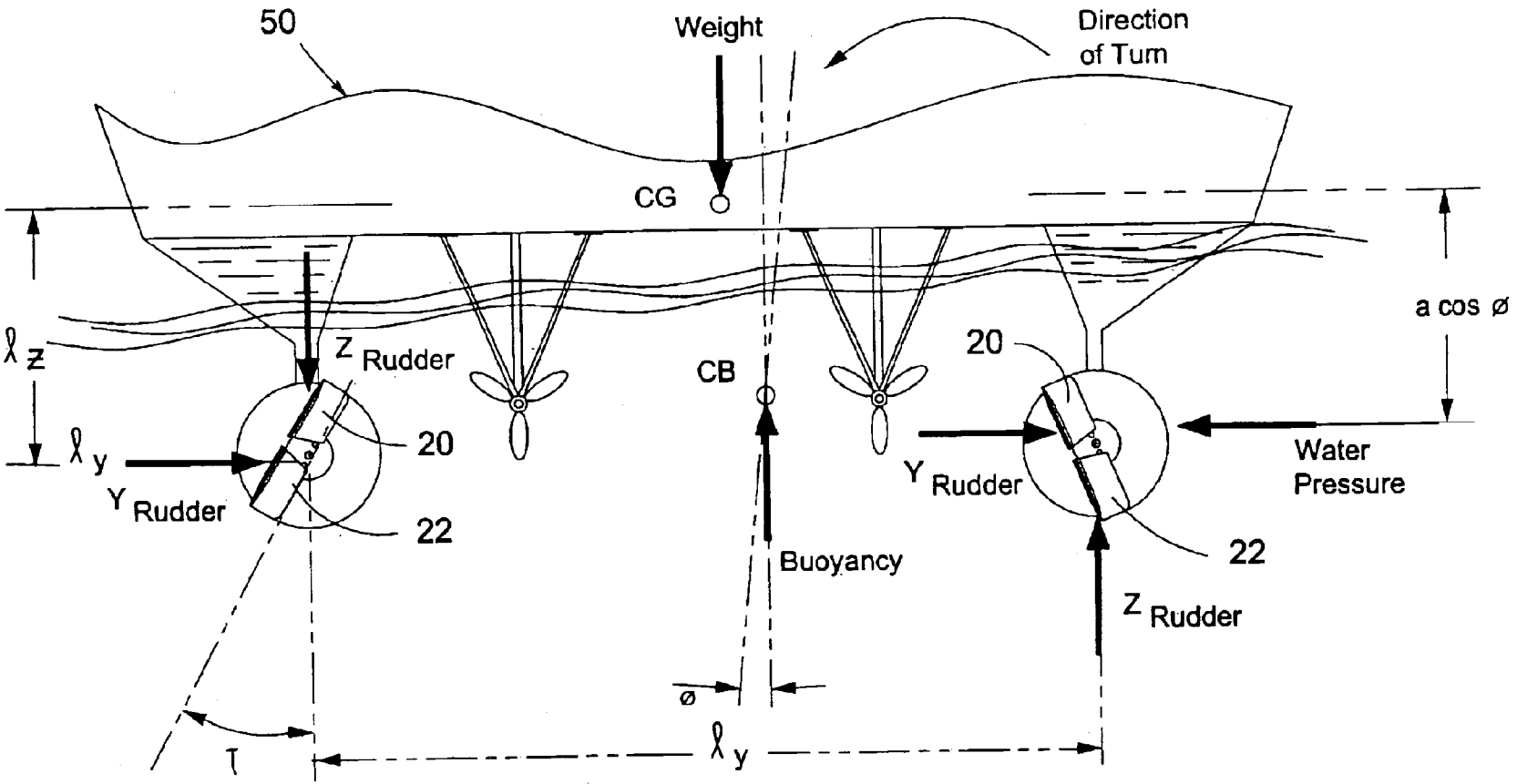
FIG. 3 is a rear view of a vessel having the present invention installed, showing the rudder members rotated to turn the vessel in a more stable manner.

A distinct advantage is offered by this 2 degree of freedom rudder/stabilizer system over a conventional rudder system. As shown in FIG. 3, rotation of the rudder/stabilizer through an angle $\tau$ about axis $X_1$ during a high speed turn exerts an additional force-couple system on the ship opposite to the direction of roll, augmenting the righting moment due to the hydrostatic properties of the vessel and the slight contribution from the horizontal lift force from the rudder. This additional moment is a function of the lift force developed by the rudder/stabilizer and the separation distance in the transverse direction. This additional moment applied to the ship has the ability to further reduce or eliminate the heeling moment allowing greater maneuverability. When rotating the rudder/stabilizer system through a small angle (X) from vertical (about axis $X_1$), a small contribution to eliminating the roll angle is realized but a large contribution to the turning capability is realized. Likewise, for large rotations of the rudder/stabilizer system through an angle $\tau$ from vertical, about axis $X_1$, a large contribution to eliminating the roll, angle is realized and a slightly reduced contribution to the turning capability is experienced. Any rotation angle $\tau$ can be selected by the operator or automated control system based on the operating scenario.

At slow speeds when the hydrostatic restoring moment is on the same order of magnitude as the heeling moment, $\tau$ is small or set to zero. Setting the rotation angle $\tau$ to zero allows the rudder lift force to be concentrated in the direction for maximum turning ability similar to a conventional rudder. Since the speed is slow the hydrostatic restoring moment is sufficient to oppose the roll angle.

During high speed maneuvers, the centrifugal force is large, thus the heeling moment is large. The angle $\tau$ is set to a large angle providing an additional restoring moment assisting the hydrostatic restoring moment. As can be seen by FIG. 3, the greater the angle $\tau$ and the greater the rudder/stabilizer separation distance the more effective this system is to resisting vessel roll during a turn without compromising performance.

For example, if a high speed turn is desired regardless of the roll angle a rotation angle $\tau=0$ degrees is chosen, or if a flat turn is desired of adequate turn rate a rotation angle of $\tau=45$ degrees is chosen. By rotating the rudder/stabilizer system through an angle $\tau=45$ degrees from vertical, a distribution of the rudder lift force (L), of 70% contributes to turning and 70% of the lift force to opposing the heeling moment.

The invention provides a control surface that minimizes rolling and pitching moments and enhances maneuverability. This is primarily accomplished by adding a second degree of freedom to a conventional rudder such that the rudder lift force can be divided into horizontal and vertical force components, providing rolling, pitching, and yawing moments opposing unwanted vessel motions caused by sea conditions or maneuvering. The equilibrium equation for roll in a steady turn below describes the moments on a vessel outfitted with this system, where the heeling moment is a function of the centrifugal force (left side of equation) and the righting moment is a function of the hydrostatic properties of the vessel and the magnitude and direction of the lift force produced by the 2 degree of freedom rudder/stabilizer (right side of equation).

$$\frac{WV^2 a\cos\phi}{gR} = W\overline{GZ} + Y_{Rud}L_Z + Z_{Rud}L_Y$$

where GZ is the horizontal distance between the center of gravity and the center of pressure (shown in FIG. 2.)

Figure 4:
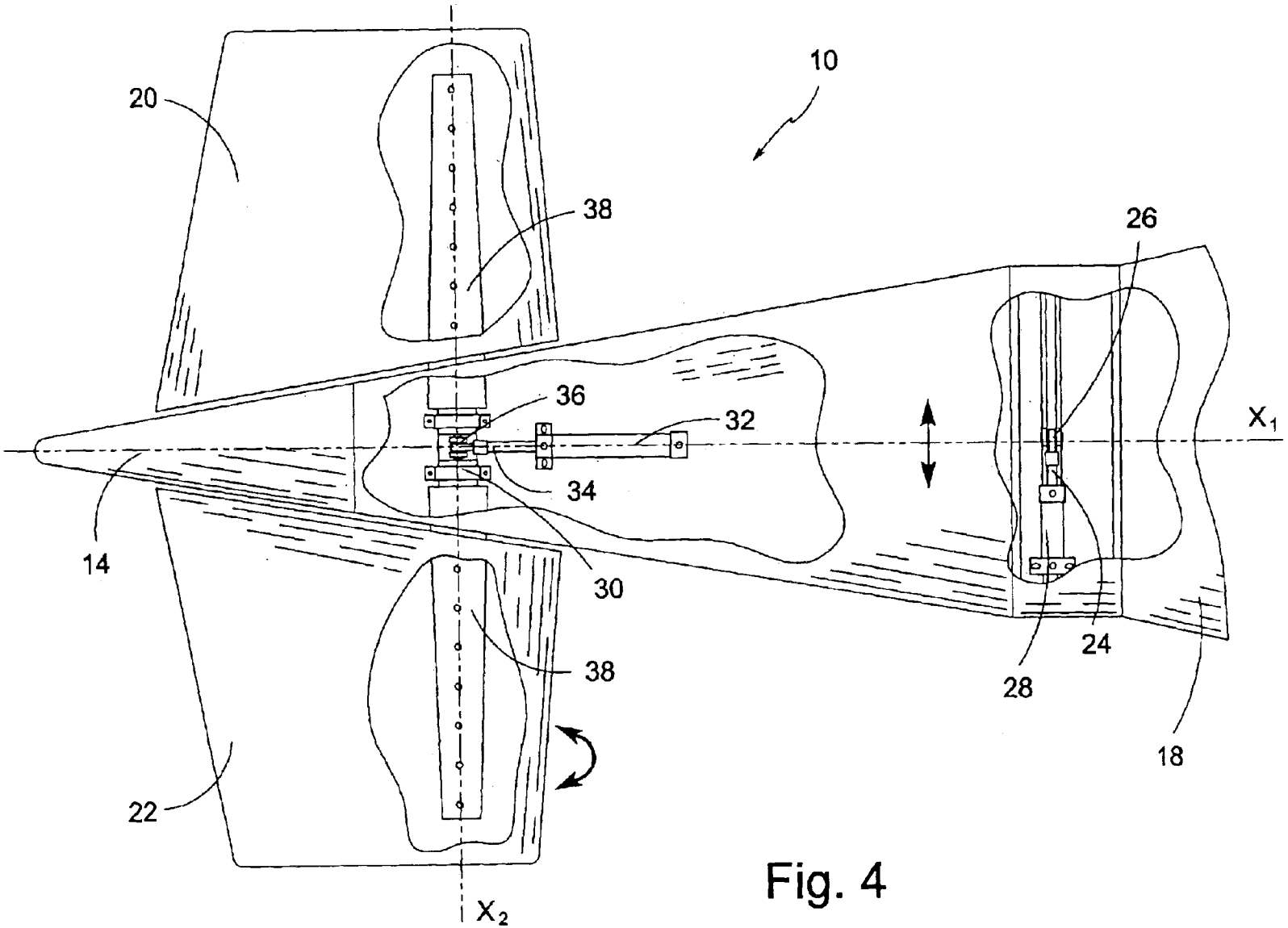
FIG. 4 is a cutaway view of an embodiment of the present invention.
Figure 8:
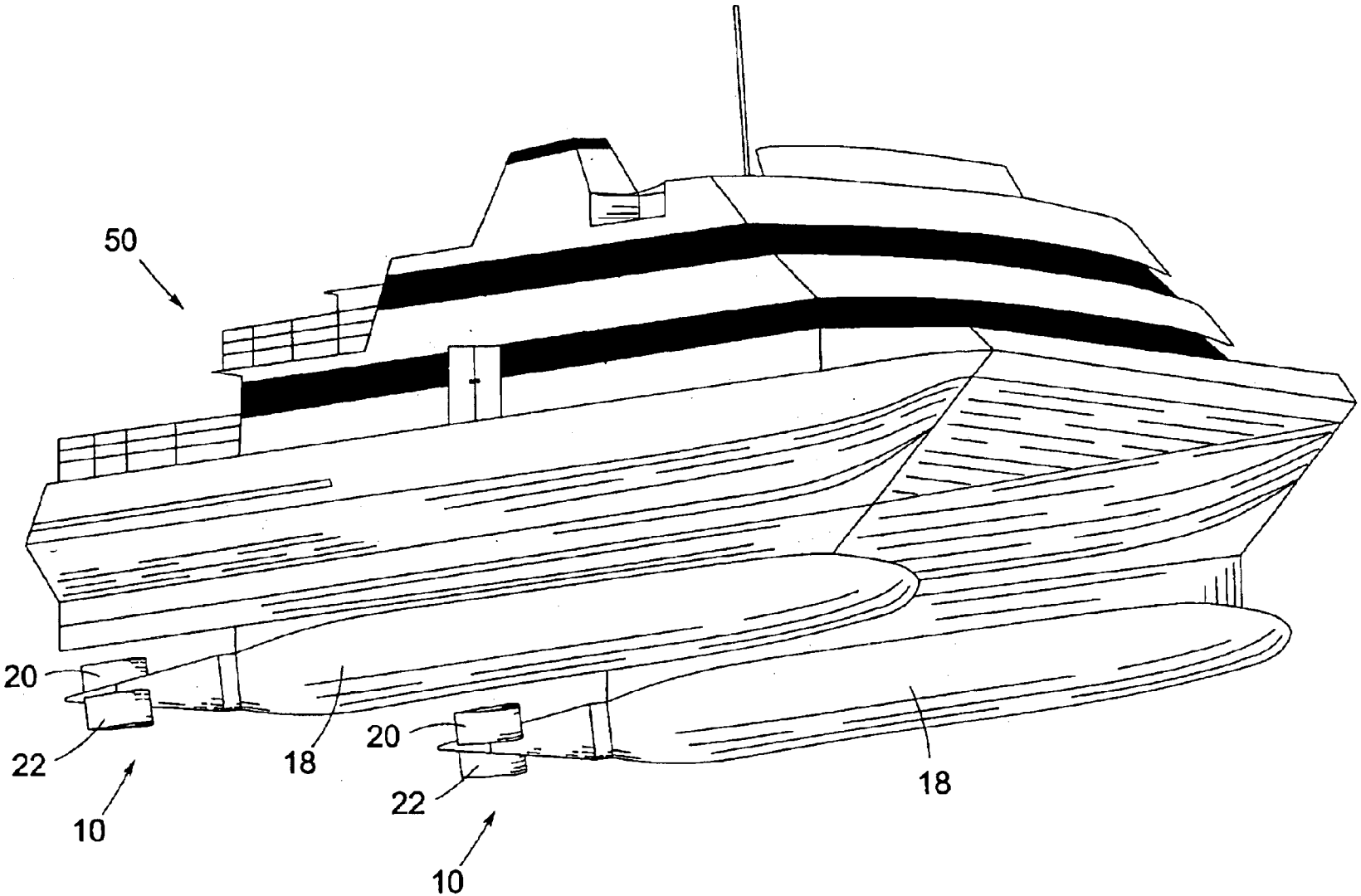
FIG. 8 is perspective view of a vessel having an embodiment of the present invention installed therein.

The present invention is shown in FIG. 4 and designated 10. The invention comprises rudder members 20 and 22 operatively arranged to be rotated around axes $X_1$ and $X_2$. $X_1$ is substantially parallel to the keel of the vessel (vessel 50 is shown in FIG. 8). $X_2$ is substantially perpendicular to $X_1$ and the keel of the vessel. Rudder members 20 and 22 are connected to body 14, which is connected to vessel portion 18. Rudder members 20 and 22 are fixed to structural member 38, which lies along axis $X_2$. Rudder members 20 and 22 are rotated around axis $X_2$ when force is exerted on rod 34 by linear actuator 32. Rod 34 is coupled to structural member 38 at coupling 36. This transfers the force exerted on rod 34 by actuator 32 to member 38. Member 38 is secured to body 14 by bracket 30, which restricts the movement of structural member 38 to a single degree of freedom, namely, rotation around axis $X_2$. Thus the force exerted on member 38 by actuator 32 serves to rotate rudder members 20 and 22 around axis $X_2$.

Rudder members 20 and 22 are rotated around axis $X_1$ when body 14 is rotated by linear actuator 28. Linear actuator 28 exerts a force on rod 24. Rod 24 is coupled to body 14 at coupling 26. This allows the force exerted by linear actuator 28 to be exerted on body 14. Body 14 is connected to vessel portion 18 in a manner that restricts the motion of body 14 to a single degree of freedom, namely, rotation around axis $X_1$.

Figure 4A:
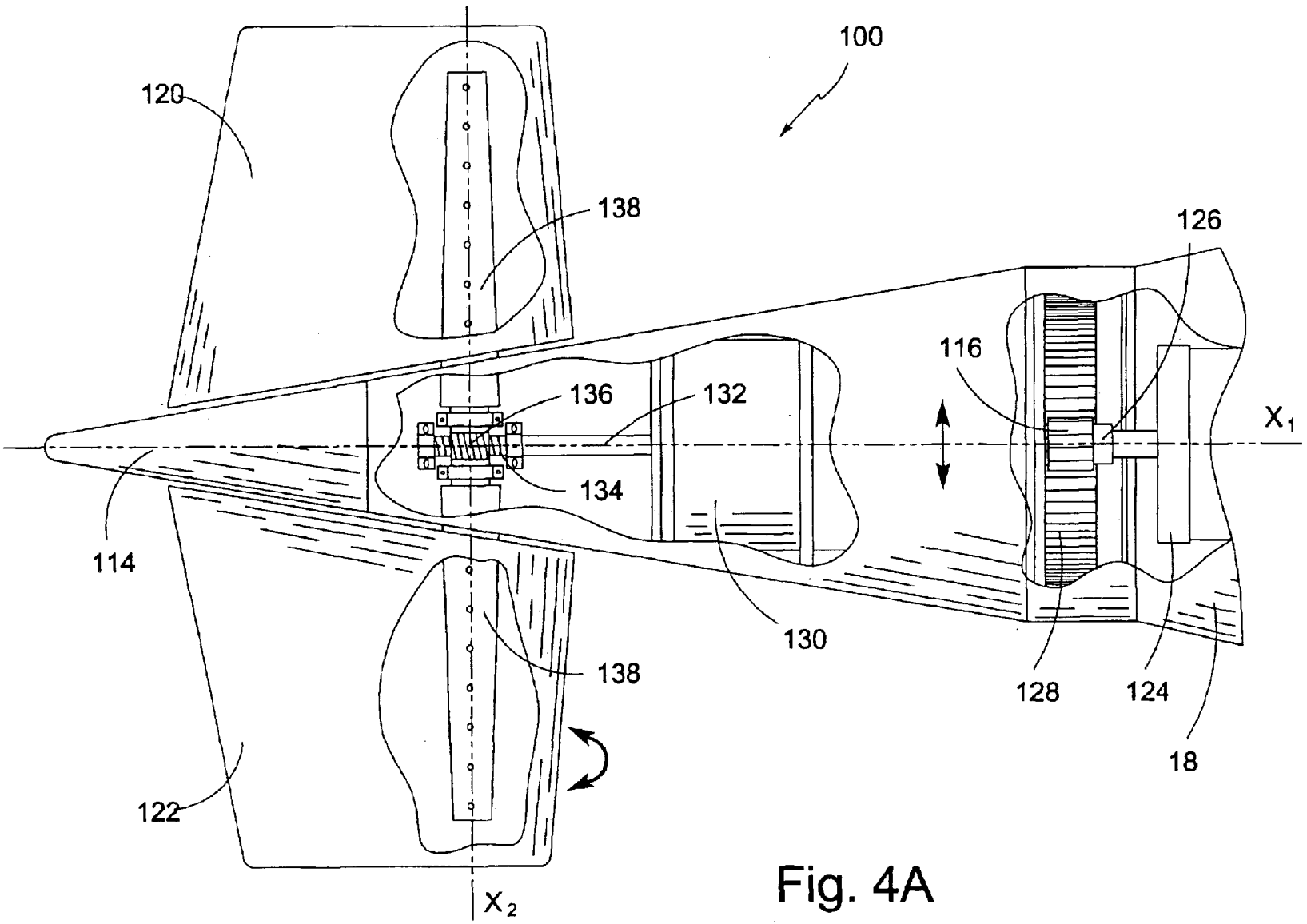
FIG. 4A is a cutaway view of an alternate embodiment of the present invention.

FIG. 4 shows one means for rotating rudder members in two degrees of freedom using linear actuators. It should be readily apparent to one skilled in the art that other means of rotating a rudder member are possible, such as that illustrated in FIG. 4A. This alternate embodiment 100 comprises rudder members 120 and 122 operatively arranged to be rotated around axes $X_1$ and $X_2$. Rudder members 120 and 122 are connected to body 114, which is connected to vessel portion 18 (vessel 50 is shown in FIG. 8). Rudder members 120 and 122 are fixed to structural member 138, which lies along axis $X_2$. Rudder members 120 and 122 are rotated around axis $X_2$ when rod 132 is rotated by motor 130. Rod 132 has a threaded portion 134 that is coupled with threaded portion 136 of structural member 138. Thus, the rotational moment created by motor 130 is transferred to member 138, rotating rudder members 120 and 122 around axis $X_2$.

Rudder members 120 and 122 are rotated around axis $X_1$ when body 114 is rotated by motor 124. Motor 124 rotates rod 126. Rod 126 comprises threaded portion 116. Threaded portion 116 is coupled with threaded portion 128 of body 114. Thus, the rotation of rod 126 by motor 124 results in the rotation of rudder members 120 and 122 around axis $X_1$. It should be readily apparent to one skilled in the art that other means of rotating a rudder member are possible, including combinations of linear actuators, rotary actuators, electrical motors, and stepper motors. These modifications are intended to be within the spirit and scope of the invention as claimed.

Figure 5:
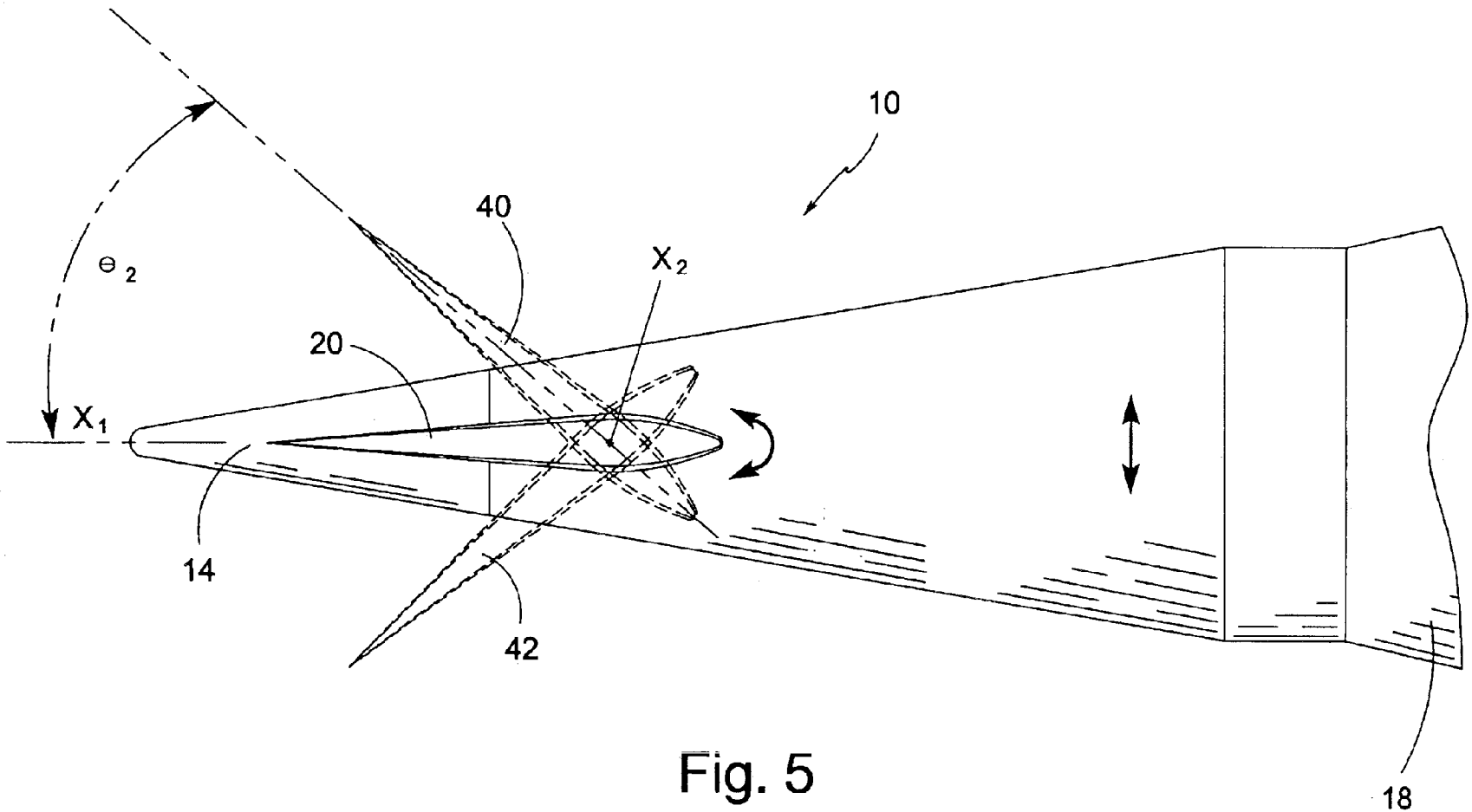
FIG. 5 is a side view of an embodiment of the present invention, showing the rudder rotating around an axis substantially perpendicular to the keel of the vessel.

FIG. 5 shows the rudder members rotated around $X_2$. Rudder member 20 is shown in solid lines substantially parallel to $X_1$. Positions 40 and 42, shown in dotted lines, show the rudder members rotated around $X_2$ such that the rudder members are no longer parallel to $X_1$.

Figure 6:
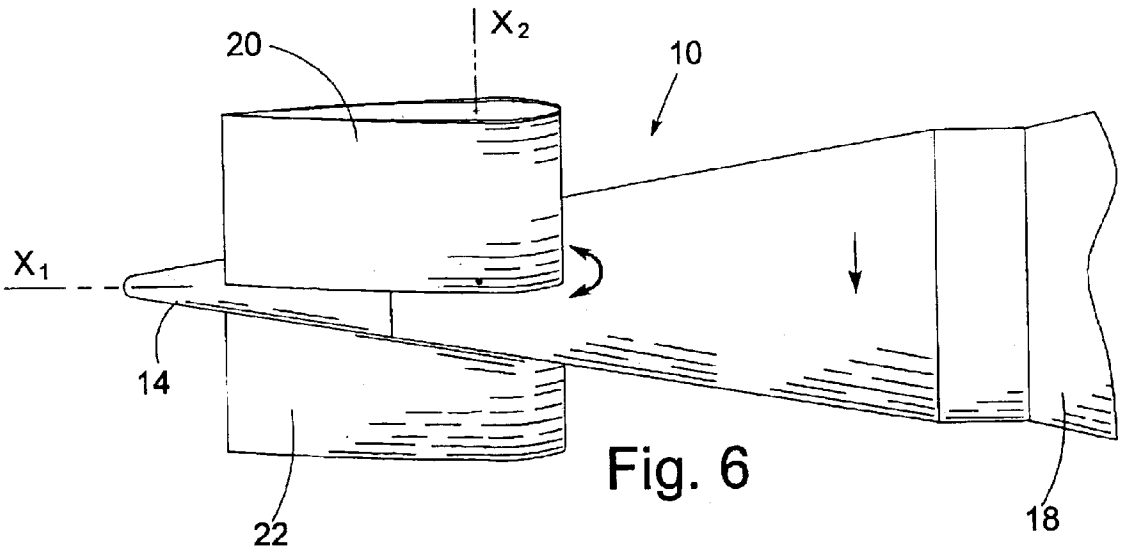
FIG. 6 is a side view of an embodiment of the present invention, showing the rudder rotating around an axis substantially parallel to the keel of the vessel.
Figure 7:
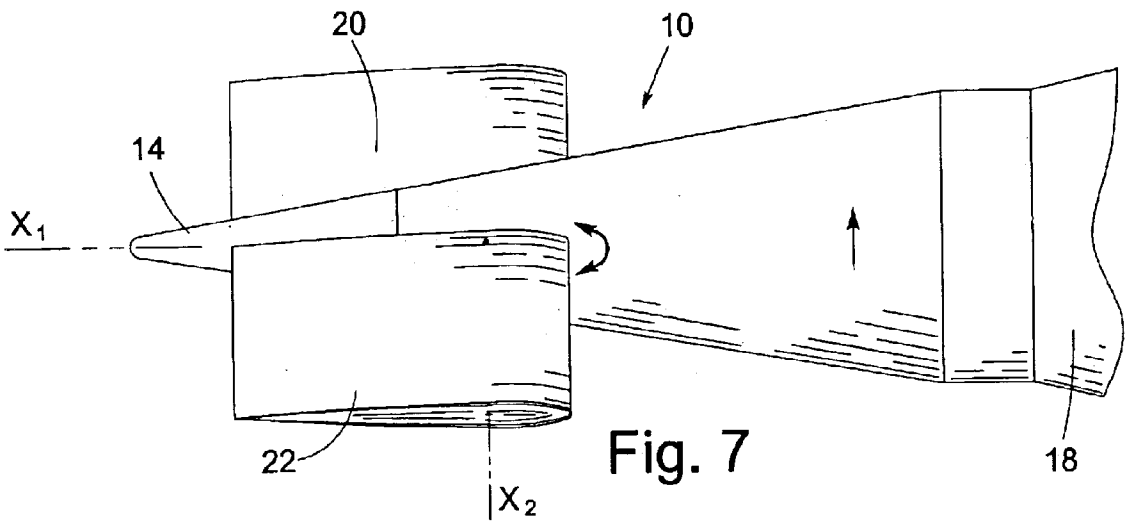
FIG. 7 is a side view of an embodiment of the present invention, showing the rudder rotating around an axis substantially parallel to the keel of the vessel.

FIGS. 6 and 7 show the rudder members being rotated around axis $X_1$. FIG. 6 shows the rudder members substantially parallel to $X_1$, with body 14 (and the rudder members) rotated around $X_1$. FIG. 7 shows body 14 and the rudder members rotated around $X_1$ in the opposite direction as FIG. 6. Angle $\tau$ (shown in FIG. 3) is the angle the rudder member is rotated around axis $X_1$.

To use the present invention, the rudder members are rotated in either one or two degrees of freedom during a turn, or while traveling straight ahead, to create a configuration that not only minimizes the pitch and roll moments produced by the hydrodynamic forces and free surface effects on the vessel, but also maximized the turning moment produced by these same hydrodynamic forces during a turn. A substantial benefit to this combined rudder/stabilizer system is the fact that the effectiveness of the rudder/stabilizer system can essentially be chosen by the operator during any conditions.

Figure 9:
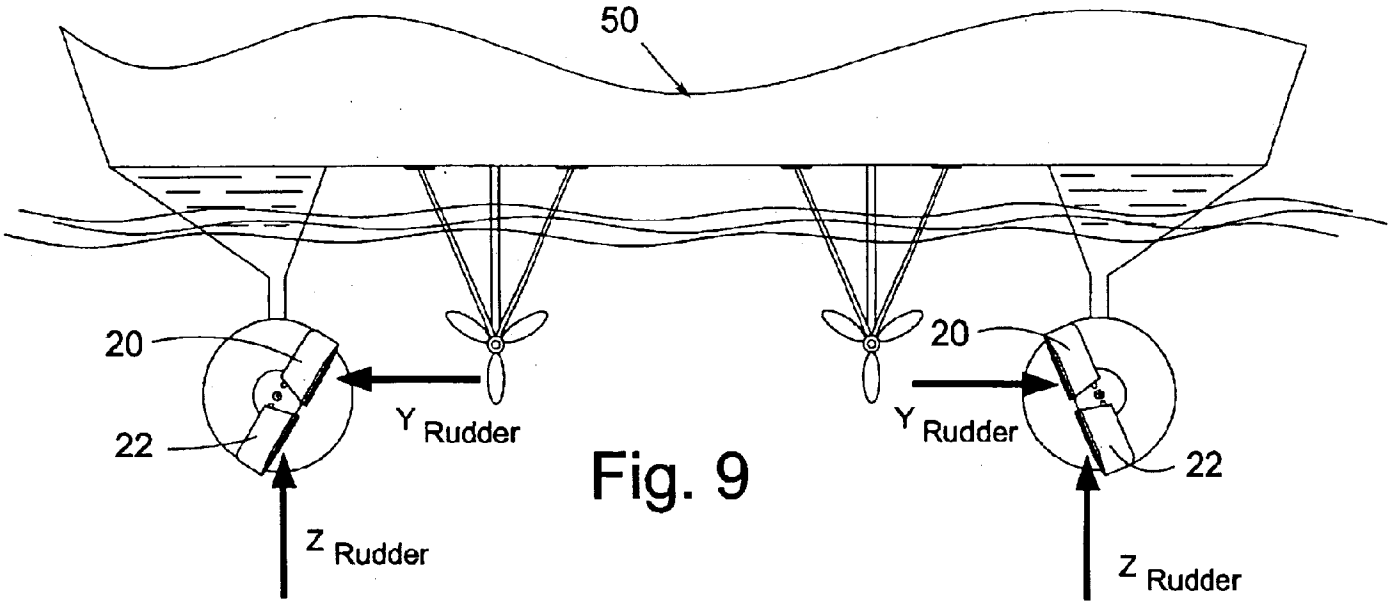
FIG. 9 is a rear view of an embodiment of the present invention with the rudder configured to guide the boat in a direction parallel to the keel of the boat.

FIG. 9 shows the preferred configuration for straight ahead travel. The rudder members are deflected at angles that are in the opposite direction, and preferably equal in magnitude, around axis $X_2$, and at angles that-are opposite in direction, and preferably equal in magnitude, around $X_1$. The rudder members are not perpendicular to the water surface, creating a pitching moment that opposes the hydrodynamic pitching moments applied to the vehicle. Substantially no turning moment is generated by the rudder members in this configuration.

Figure 10:
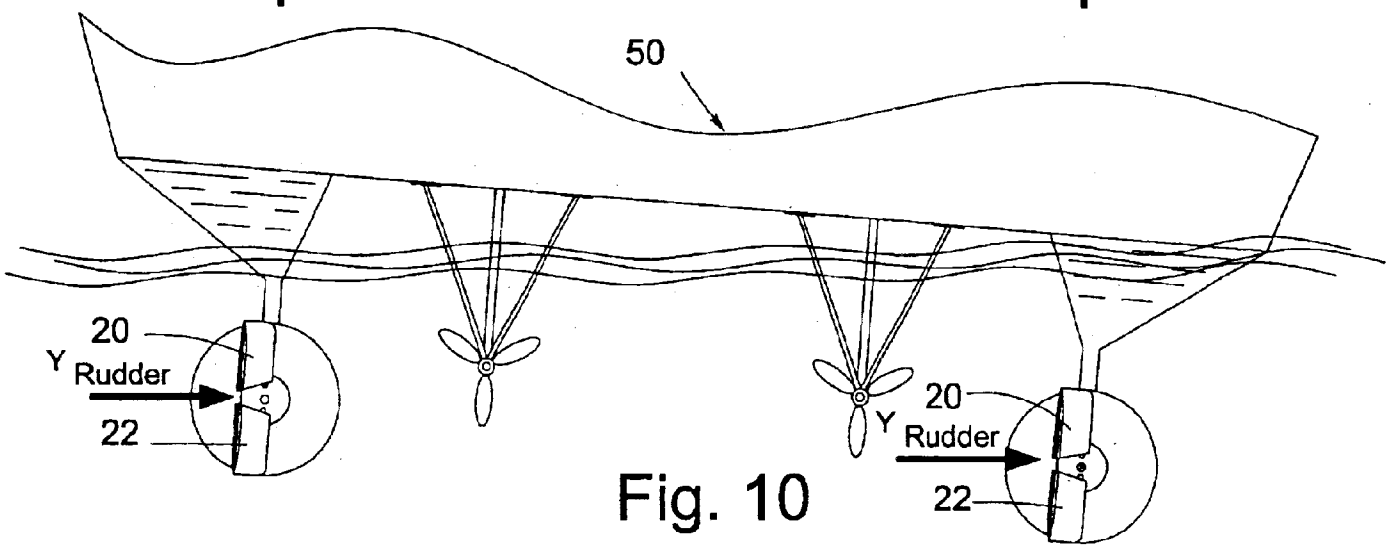
FIG. 10 is a rear view of an embodiment of the present invention, configured to turn the boat at a low speed in a direction counterclockwise when the vessel is viewed from above.

FIG. 10 shows the preferred configuration for slow speed turns. Here the rudder members 20 are deflected only around axis $X_2$, such that the planar surface is perpendicular to the water surface, as with a conventional rudder. During a slow speed turn, the hydrostatic restoring moment caused by the vessel buoyancy is more predominant than the roll moment caused by hydrodynamic forces created from the vessel turning motion through the water. Thus, the total hydrodynamic force applied on the rudder/stabilizer can be utilized to cause a turning moment on the vessel, maximizing turning capacity.

Figure 11:
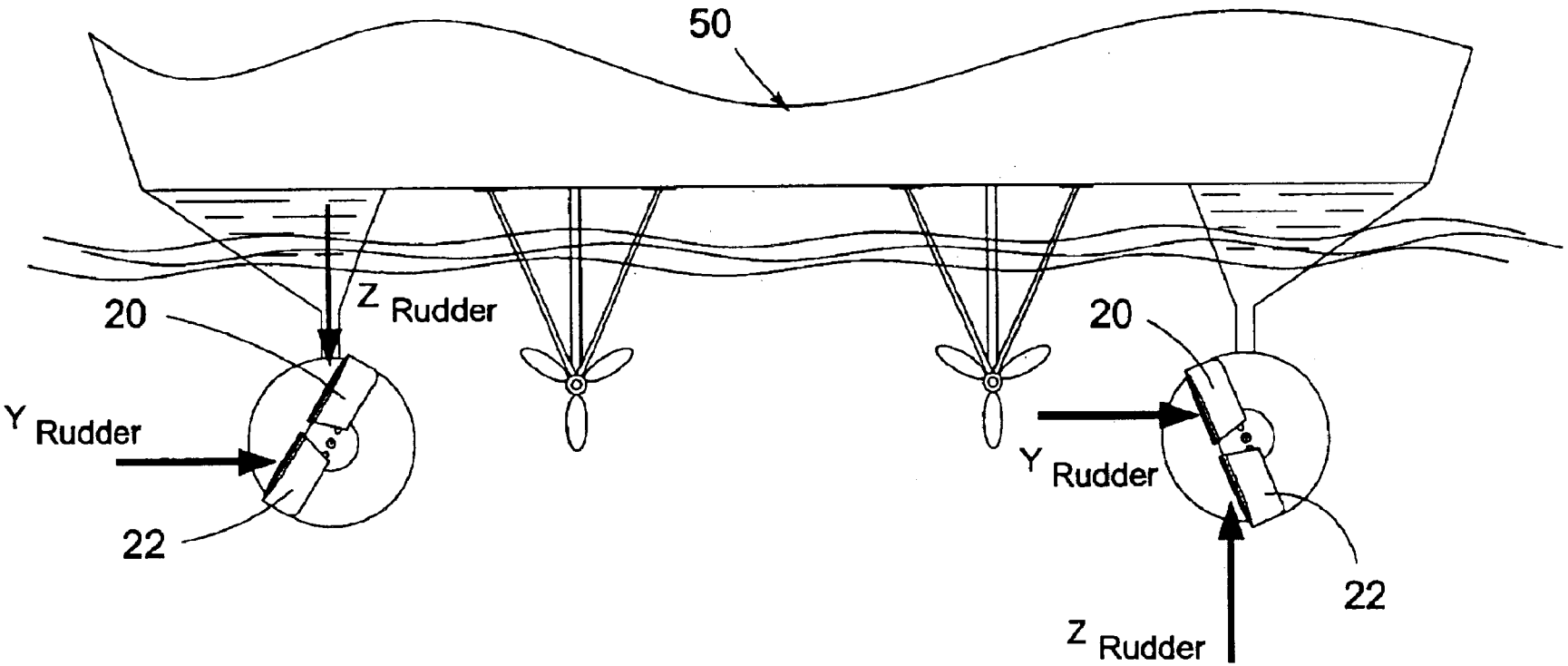
FIG. 11 is a rear view of an embodiment of the present invention with the rudder rotated around two substantially perpendicular axes, configured to turn the boat at a high speed in a direction counterclockwise when the vessel is viewed from above; and, FIG. 12 is a rear view of an embodiment of the present invention installed on a crossfoil attached to the vessel hull.

FIG. 11 shows the preferred configuration for high speed turns. The rudder members deflected at angles that are in the same direction and preferably equal in magnitude, around axis $X_2$, and at angles that are opposite in direction, and preferably equal in magnitude, around $X_1$. The planar surfaces are not perpendicular to the water surface, which creates a combined turning and rolling moment that opposes the hydrodynamic rolling moment applied to the vessel. The restoring moment has a higher magnitude than that for the conventional rudder at all roll angles of inclination. Thus, the equilibrium condition is reached at a much smaller roll angle of inclination than for a conventional rudder.

Figure 12:
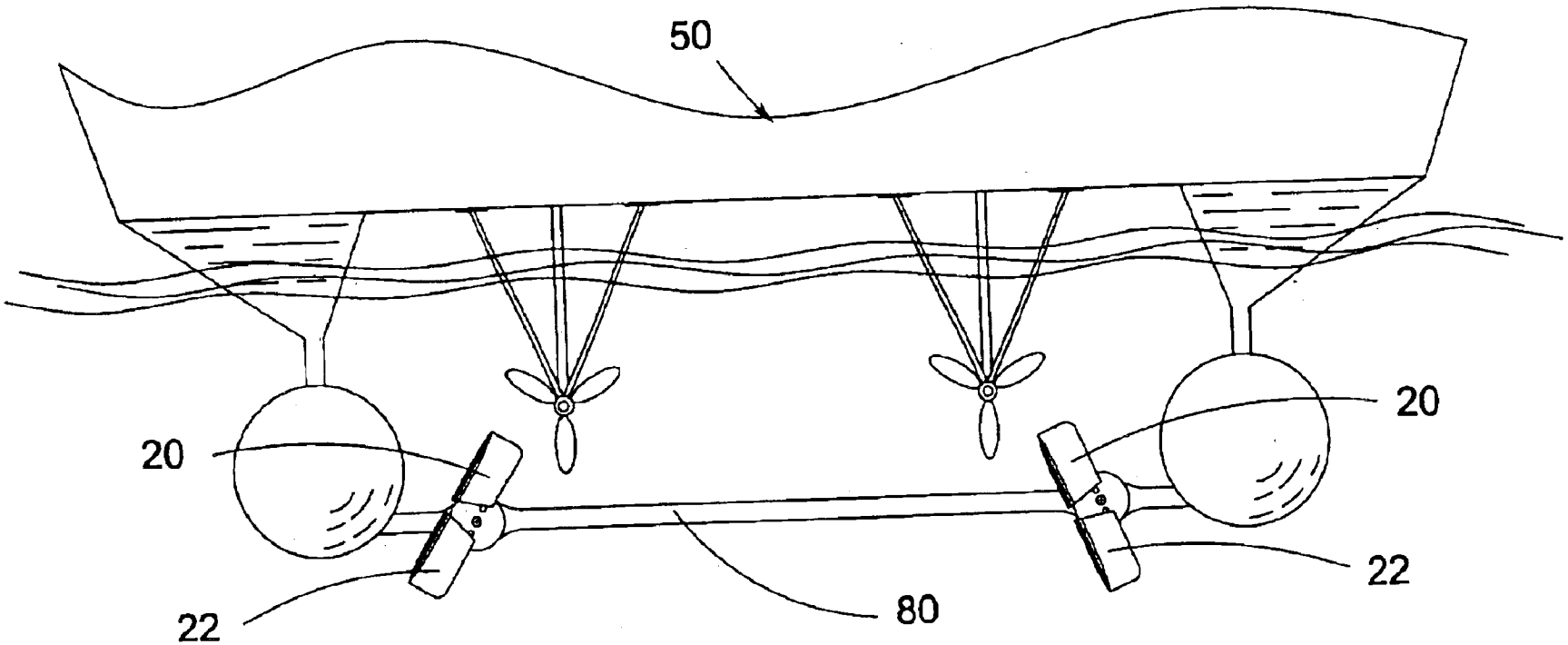

FIG. 12 shows rudder members 20 and 22 of the present invention attached to crossfoil 80. Crossfoil 80 is secured to the hull of vessel 50. It should be readily apparent to one skilled in the art that the present invention may be attached to the vessel hull directly, to a crossfoil attached to the hull, or in any other manner known in the art. These modifications are intended to be within the spirit and scope of the invention as claimed.

It should be readily apparent to one skilled in the art that the configurations that minimize pitch and roll moments differ based on the size of the vessel, the shape and size of the rudder members, the velocity of the vessel, and other factors. The configurations that minimize pitch and roll moments must be determined through analysis and validated experimentally based on the vessel configuration.

The attached drawings show rudder members rotatable around an axis substantially parallel to the keel of the vessel ($X_1$), and an axis substantially perpendicular to the is keel of the vessel ($X_2$). However, it should be readily apparent to one skilled in the art that other configurations wherein at least one rudder member is rotatable in two degrees of freedom are possible, including configurations wherein the two axes are not substantially perpendicular. These modifications are intended to be within the spirit and scope of the invention as claimed.

Thus, it is seen that the objects of the present invention are efficiently obtained, although modifications and changes to the invention should be readily apparent to those having ordinary skill in the art, and these modifications are intended to be within the spirit and scope of the invention as claimed.

What is claimed is:

1. A method for integrating steering and motion control in a vessel comprising the steps of:

mounting first and second rudder bodies to a vessel, wherein said first rudder body is located on a first side of a centerline of said vessel and said second rudder body is located on a second side, opposite said first side of said centerline and said centerline is parallel with a keel of said vessel;

mounting at least one first rudder member to said first rudder body and at least one second rudder member to said second rudder body; and, rotating said first and second rudder bodies around respective first axis and said at least one first and second rudder members around respective second axis using at least one rotating means, wherein said rotation of said first and second rudder bodies and said at least one first and second rudder members steers said vessel and controls motion of said vessel.

2. The method recited in claim 1 wherein said respective first axis is substantially parallel to said keel.

3. The method recited in claim 1 wherein said respective second axis is substantially perpendicular to said respective first axis.

4. The method recited in claim 1 wherein controlling motion of said vessel further comprises controlling roll and ditch motion of said vessel.

5. The method recited in claim 1 wherein said vessel further comprises an automatic control system; and, wherein rotating said first and second rudder bodies and said at least one first and second rudder members are responsive to said automatic control system.

6. The method recited in claim 1 further comprising:

rotating said first and second rudder bodies independently of each another;

rotating said at least one first rudder member and said first rudder body independently of each other;

rotating said at least one second rudder member and said second rudder body independently of each other; and, rotating said at least one first and second rudder members independently of each other.

7. The method recited in claim 6 further comprising:

rotating said first and second rudder bodies in opposite directions.

8. The method recited in claim 1 wherein said at least one rotating means further comprises a linear actuator.

9. The method recited in claim 1 wherein said at least one rotating means further comprises a rotary actuator.

10. The method recited in claim 1 wherein said at least one rotating means further comprises an electrical motor.

11. The method recited in claim 1 wherein said at least one rotating means further comprises a stepper motor.

12. A rudder comprising:

a rudder body;

at least one rudder member mounted to said first rudder body; and, at least one rotating means arranged to rotate said rudder body around a first axis and said at least one rudder member around a second axis wherein said rudder body and said at least one rudder member are arranged to rotate independently of each other.

13. The rudder recited in claim 12, wherein said second axis is substantially perpendicular to said first axis.

14. The rudder recited in claim 12 wherein said at least one rotating means further comprises a linear actuator.

15. The rudder recited in claim 12 wherein said at least one rotating means further comprises a rotary actuator.

16. The rudder recited in claim 12 wherein said at least one rotating means further comprises an electrical motor.

17. The rudder recited in claim 12 wherein said at least one rotating means further comprises a stepper motor.

18. The rudder recited in claim 12 wherein said at least one rotating means further comprises a first rotating means arranged to rotate said rudder body and a second rotating means arranged to rotate said at least one rudder member.

19. An apparatus for steering and controlling motion in a vessel comprising:

a first rudder body and at least one first rudder member mounted to said first rudder body;

a second rudder body and at least one second rudder member mounted to said second rudder body;

at least one rotating means arranged to rotate said first and second rudder bodies around respective first axis and said at least one first and second rudder members around respective second axis; and, wherein said first and second rudder bodies are arranged to rotate independently of each other and said rotation of said first and second rudder bodies and said at least one first and second rudder members steers said vessel and controls motion of said vessel.

20. The apparatus recited in claim 19 wherein said vessel further comprises a first keel and said respective first axis is substantially parallel to said first keel.

21. The apparatus vessel recited in claim 19, wherein said respective second axis is substantially perpendicular to said respective first axis.

22. The apparatus recited in claim 19 wherein said at least one rotating means further comprises a linear actuator.

23. The apparatus vessel recited in claim 19 wherein said at least one rotating means further comprises a rotary actuator.

24. The apparatus recited in claim 19 wherein said at least one rotating means further comprises an electrical motor.

25. The apparatus vessel recited in claim 19 wherein said at least one rotating means further comprises a stepper motor.

26. The apparatus recited in claim 19 wherein said vessel comprises a second keel and a centerline essentially parallel with said second keel; and, wherein said first rudder body is disposed on a first side of said centerline and said second rudder body is disposed on a second side, opposite said first side, of said centerline.

27. The apparatus recited in claim 19, wherein said first and second rudder bodies and said at least one first and second rudder members are arranged to be rotated to control roll and pitch motion of said vessel.

28. The apparatus recited in claim 19 wherein said first rudder body and said at least one first rudder member are arranged to be rotated independently of each other, said second rudder body and said at least one second rudder member are arranged to be rotated independently of each other, and said at least one first and second rudder members are arranged to be rotated independently of each other.

29. The apparatus recited in claim 28 wherein said first and second rudder bodies are arranged to rotate in opposite directions.

30. The apparatus recited in claim 19 wherein said vessel further comprises an automatic control system; and, wherein said at least one rotating means is responsive to said automatic control system.

31. A vessel comprising:

a hull;

first and second rudder bodies mounted to said hull, wherein said first rudder body is located on a first side of a centerline of said vessel and said second rudder body is located on a on a second side, opposite said first side, of said centerline and said centerline is parallel with a keel of said vessel;

at least one first rudder member mounted to said first rudder body and at least one second rudder member mounted to said second rudder body;

at least one rotating means arranged to rotate said first and second rudder bodies around respective first axis and said at least one first and second rudder member around respective second axis; and, wherein said rotation of said first and second rudder bodies and said at least one first and second rudder members steers said vessel and controls motion of said vessel.

32. The vessel recited in claim 31, wherein said vessel further comprises a keel and said respective first axis is substantially parallel to said keel.

33. The vessel recited in claim 31 wherein said respective second axis is substantially perpendicular to said respective first axis.

34. The vessel recited in claim 31 wherein said first and second rudder bodies and said at least one first and second rudder members are arranged to be rotated to control roll and pitch motion of said vessel.

35. The vessel recited in claim 31 wherein said first and second rudder bodies are arranged to be rotated independently of each other.

36. The apparatus recited in claim 35 wherein said first rudder body and said at least one first rudder member are arranged to be rotated independently of each other, said second rudder body and said at least one second rudder member are arranged to be rotated independently of each other, and said at least one first and second rudder members are arranged to be rotated independently of each other.

37. The apparatus recited in claim 35 wherein said first and second rudder bodies are arranged to rotate in opposite directions.

38. The vessel recited in claim 31, wherein said at least one rotating means further comprises a linear actuator.

39. The vessel recited in claim 31, wherein said at least one rotating means further comprises a rotary actuator.

40. The vessel recited in claim 31, wherein said at least one rotating means further comprises an electrical motor.

41. The vessel recited in claim 31, wherein said at least one rotating means further comprises a stepper motor.

42. The vessel recited in claim 31 further comprising first and second appendages fixed to said hull; and, wherein said first rudder body is mounted to said first appendage and said second rudder body is mounted to said second appendage.

43. The vessel recited in claim 42 wherein said first and second appendages are each a crossfoil.

44. The vessel recited in claim 31 wherein said vessel further comprises an automatic control system; and, wherein said at least one first and second rotating means are responsive to said automatic control system.

* * * * *

UNITED STATES PATENT AND TRADEMARK OFFICE

CERTIFICATE OF CORRECTION

PATENT NO. : 6,880,478 B2 
DATED : April 19, 2005
INVENTOR(S) : Steven J. Schmitz, Sr. and Terrence W. Schmidt It is certified that error appears in the above-identified patent and that said Letters Patent is hereby corrected as shown below:

Column 7,
Lines 60-62, should read
4. The method recited in Claim 1 wherein controlling motion of said vessel further comprises controlling roll and pitch motion of said vessel.

Column 8,
Lines 63-65, should read
21. The apparatus recited in Claim 19, wherein said respective second axis is substantially perpendicular to said respective first axis.

Column 9,
Lines 1-3, should read
23. The apparatus recited in Claim 19 wherein said at least one rotating means further comprises a rotary actuator.
Lines 6-8, should read
25. The apparatus recited in Claim 19 wherein said at least one rotating means further comprises a stepper motor.

Signed and Sealed this

Ninth Day of August, 2005

JON W. DUDAS
*Director of the United States Patent and Trademark Office*